United States Patent [19]

Ishida

[11] Patent Number: 4,481,914

[45] Date of Patent: Nov. 13, 1984

[54] ACCELERATOR PUMP SYSTEM FOR CARBURETORS

[75] Inventor: Tokuzi Ishida, Hamamatsu, Japan

[73] Assignee: Suzuki Jidosha Kogyo Kabushiki Kaisha, Shizuoka, Japan

[21] Appl. No.: 430,065

[22] Filed: Sep. 30, 1982

[30] Foreign Application Priority Data

Dec. 7, 1981 [JP] Japan ..... 56-195565

[51] Int. Cl.[3] ..... F02M 1/14

[52] U.S. Cl. ..... 123/179 G; 261/34 A

[58] Field of Search ..... 123/179 G; 261/34 A, 261/34 B

[56] References Cited

U.S. PATENT DOCUMENTS

| | | | |
|---|---|---|---|
| 2,768,818 | 10/1956 | Egerer | 261/34 A |
| 3,730,495 | 5/1973 | Elam | 261/34 A |
| 3,911,062 | 10/1975 | Johnson | 261/34 A |
| 3,934,571 | 1/1976 | Mennesson | 123/179 G |
| 4,172,864 | 10/1979 | Hohsho et al. | 261/39 D |
| 4,194,483 | 3/1980 | McChesney et al. | 123/179 G |
| 4,272,459 | 6/1981 | Berger | 261/34 A |

FOREIGN PATENT DOCUMENTS

| | | | |
|---|---|---|---|
| 1191630 | 4/1965 | Fed. Rep. of Germany | 261/34 A |
| 2021315 | 1/1972 | Fed. Rep. of Germany | 123/179 G |

*Primary Examiner*—Andrew M. Dolinar

*Attorney, Agent, or Firm*—Flynn, Thiel, Boutell & Tanis

[57] ABSTRACT

An accelerator pump supplies additional fuel into a primary intake passage when a primary throttle valve is opened. A vacuum-operated actuator is responsive to a vacuum developed in a manifold passage upon cranking for actuating an accelerator pump plunger to discharge extra fuel into the primary intake passage. When the engine which is cold is to be started, such an additional supply of fuel assists the engine in getting started quickly. When the engine which is hot is to be restarted, the actuation of the accelerator pump clears away fuel vapor from the accelerator pump and a fuel feed passage connected therewith, thus readying the accelerator pump for normal operation. The primary throttle valve is operatively connected to the accelerator pump through a plate cam having a cam edge which is profiled such that the amount of extra fuel as supplied by the accelerator pump is proportional to opening of the primary throttle valve.

5 Claims, 1 Drawing Figure

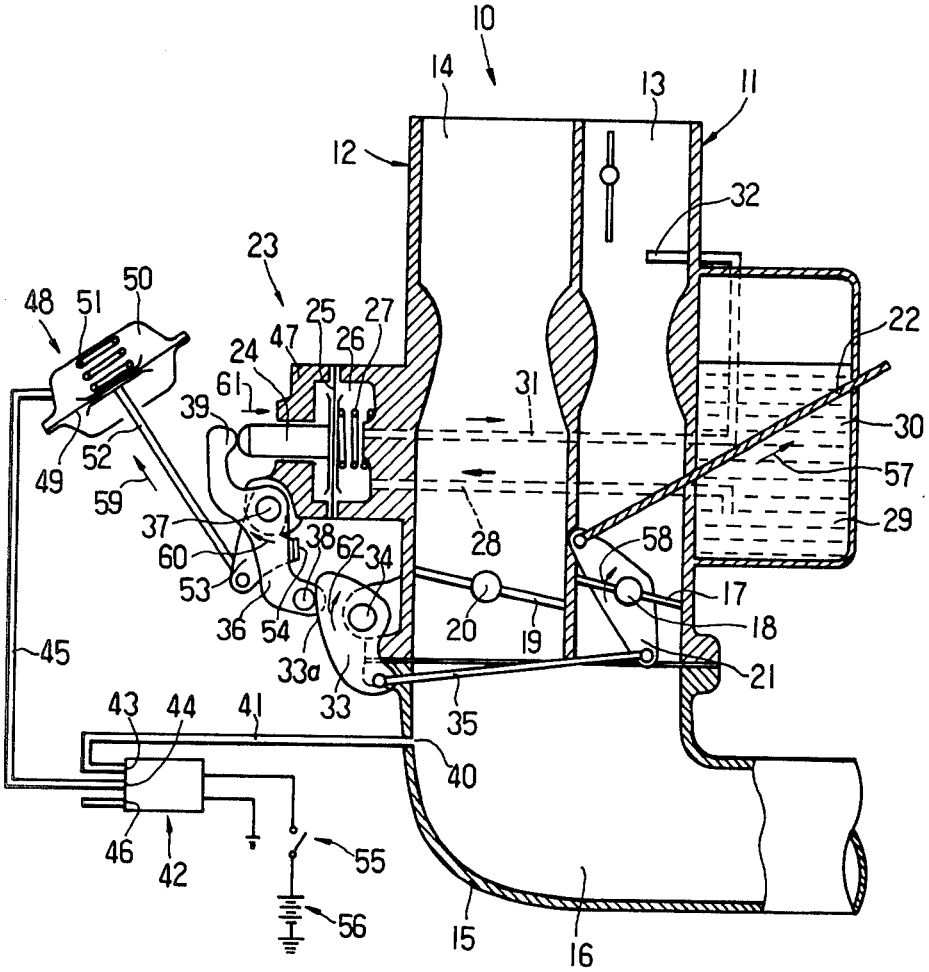
10
14
13
11
12
32
23
48
51
50
25
27
47
26
24
22
61
39
31
30
52
49
57
59
37
38
62
34
28
58
29
60
53
36
54
20
19
17
18
45
33a
33
21
43
44
41
35
40
46
42
55
56
15
16

ACCELERATOR PUMP SYSTEM FOR CARBURETORS

BACKGROUND OF THE INVENTION

The present invention relates to an accelerator pump system for a carburetor of an internal combustion engine.

There have heretofore been known carburetors having an accelerator pump for supplying additional fuel to an engine upon acceleration to meet a demand for increased engine power. Such an accelerator pump also serves to provide a two-barrel carburetor with better transient conditions in which a secondary intake passage comes into operation in addition to a primary intake passage. It frequently happens that a car runs continuously for a certain period of time, is stopped with the engine turned off, and then the engine is restarted for acceleration. Under such a running condition, however, the accelerator pump and associated fuel passages are filled with fuel vapor due to percolation caused by heat of the engine while the car is held at rest. The fuel passages suffer from vapor lock which renders fuel feed less responsive. With a two-barrel carburetor having primary and secondary intake passages having a large ratio between their cross-sectional areas, the vapor lock gives rise to poor transient conditions in which the secondary intake passage comes into operation, resulting in hesitation or stumble and hence poor drivability.

SUMMARY OF THE INVENTION

Therefore, it is an object of the present invention to provide an accelerator pump system for two-barrel carburetors of internal combustion engines which includes means for removing fuel vapor from an accelerator pump and associated fuel passages so that a secondary intake passage will come into operation under smooth transient conditions for quick engine response and improved driving performance.

Another object of the present invention is to provide an accelerator pump system for carburetors which can start an internal combustion engine reliably while the latter is cold.

Still another object of the present invention is to provide an accelerator pump system which can provide extra fuel needed for acceleration in an amount proportional to the degree of acceleration.

According to the present invention, an accelerator pump system for an internal combustion engine comprises a primary intake passage for supplying an air-fuel mixture to the engine when the engine operates under a full range of loads, the primary intake passage having therein a primary throttle valve, a secondary intake passage for supplying an air-fuel mixture to the engine when the engine operates under relatively high loads, an accelerator pump actuatable in response to opening of the primary throttle valve for supplying additional fuel into the primary intake passage, and means for actuating the accelerator pump in response to cranking of the engine.

The actuating means comprises a vacuum-operated actuator responsive to a vacuum developed in a manifold passage upon the cranking of the engine for actuating the accelerator pump.

When the engine is to be started while it is cold, the accelerator pump is actuated to inject fuel into the primary intake passage for enriching the air-fuel mixture flowing therethrough. Therefore, the engine can be started quickly. When the engine is to be restarted while it is being hot, the actuation of the accelerator pump discharges fuel vapor from the accelerator pump and fuel passages connected therewith, readying the accelerator pump for quick fuel feed response and improved drivability. The accelerator pump is operatively connected to the primary throttle valve through a plate cam which is profiled such that the accelerator pump will be actuated in proportion to the degree of acceleration or opening of the primary throttle valve. With this arrangement, the extra fuel can be supplied into the primary intake passage in an amount that meets the acceleration requirement for improved drivability and fuel economy.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWING

The sole FIGURE is a schematic diagram, partly in cross section, of an accelerator pump system according to the present invention.

DETAILED DESCRIPTION

As shown, a two-barrel carburetor 10 for an internal combustion engine is composed of a primary barrel 11 for supplying an air-fuel mixture to the engine under a full range of loads and a secondary barrel 12 for supplying an air-fuel mixture to the engine under relatively high loads. The primary and secondary barrels 11, 12 have primary and secondary intake passages 13, 14, respectively. An intake manifold 15 having a manifold passage 16 is connected to the two-barrel carburetor 10 with the manifold passage 16 communicating with the primary and secondary intake passages 13, 14. A primary throttle valve 17 is swingably mounted by a shaft 18 in the primary intake passage 13, and likewise a secondary throttle valve 19 is swingably mounted by a shaft 20 in the secondary intake passage 14. A throttle lever 21 is fixed to the shaft 18 and operatively connected to an accelerator pedal (not shown) through a throttle wire 22.

An accelerator pump 23 includes a plunger 24 movably extending into a pump housing 47 in which there is mounted a diaphragm 25 coupled to the plunger 24. The diaphragm 25 defines in the pump housing 47 a pump chamber 26 accommodating therein a compression spring 27 for normally urging the diaphragm 25 in a direction to push out the plunger 24 or enlarge the pump chamber 26. The pump chamber 26 communicates with a fuel supply passage 28 supplied with fuel 29 contained in a float chamber 30 and also communicates with a fuel feed passage 31 having a fuel outlet port 32 opening into the primary intake passage 13 upstream of the primary throttle valve 17 with respect to the direction of flow of the air-fuel mixture through the primary intake passage 13. A plate cam 33 is pivotably mounted by a pin 34 on the carburetor 10 and is linked to the throttle lever 21 by a connector link 35, the plate cam 33 having a cam edge **33*a* profiled to give a required motion to the plunger 24 of the accelerator pump 23, as will described later on. A pump lever 36 is pivotably mounted by a pin 37 on the pump housing 47 and has on one end a roller 38 held against the cam edge 33*a* of the plate cam 33 and on the other end a presser 39 pressed against the projecting end of the plunger 24**.

A vacuum signal pickup port 40 opens into the manifold passage 16 at a position downstream of the secondary throttle valve 19 and is held in communication through a first vacuum passage 41. A directional control valve 42 has a first port 43 communicating with the first vacuum passage 41, a second port 44 communicating with a second vacuum passage 45, and a third port 46 vented to the atmosphere. The second vacuum passage 45 is connected to a vacuum-operated actuator 48 having a diaphragm 49 defining a vacuum chamber 50 which accommodates a compression spring 51, the vacuum chamber 50 communicating with the second vacuum passage 45. An actuator link 52 is attached at one end to the diaphragm 49 and pivotably connected at the other end to a lever 53 pivotably mounted on the pin 37 and having a hook 54 engageable with the pump lever 36 when the vacuum-operated actuator 48 is actuated. The diaphragm 49 is normally urged by the compression spring 51 to push the actuator link 52 downwardly in a direction to disengage the hook 54 from the pump lever 36. The directional control valve 42 has a solenoid (not shown) energizable by a battery 56 when an ignition switch 55 connected thereto is turned on. When the directional control valve 42 is thus energized, the first port 43 and the second port 44 are brought into mutual communication, allowing a vacuum to be supplied from the vacuum signal pickup port 44 through the first and second passages 41, 45 into the vacuum chamber 50 of the vacuum-operated actuator 48 to thereby pull the actuator link 52. When the ignition switch 55 is turned off, the second and third ports 44, 46 are brought into mutual communication to thereby vent the vacuum chamber 50 to atmosphere, whereupon the actuator link 52 is pushed out under the resiliency of the compression spring 51.

The accelerator pump system thus constructed will operate as follows. When the ignition switch 55 is turned on for cranking to start the engine which is cold or hot, a cranking signal is supplied from the ignition switch 55 to the directional control valve 42 to connect the first and second ports 43, 44. The cranking develops a vacuum in the manifold passage 16 which is picked up by the vacuum signal pickup port 40 and delivered through the first vacuum passage 41, the directional control valve 42, the second vacuum passage 45 to the vacuum chamber 50 of the vacuum-operated actuator 48. The diaphragm 49 is now caused to flex into the vacuum chamber 50 for thereby lifting the actuator link 52 in the direction of the arrow 59, which then turns the lever 53 clockwise in the direction of the arrow 60 about the pin 37. The hook 54 is brought into engagement with the pump lever 36 and causes the latter to turn clockwise in the direction of the arrow 60 about the pin 37, whereupon the presser 39 pushes in the plunger 24 to reduce the volume of the pump chamber 26. Therefore, fuel in the fuel feed passage 31 is forced to flow out of the port 32 into the primary intake passage 13. When the engine is to be started while it is cold, such additional fuel supplied via the port 32 into the primary barrel 11 assists the engine in getting started quickly. When the engine is to be restarted while it is being hot, fuel vapor created in the pump chamber 26 and the fuel supply and feed passages 28, 31 due to percolation is discharged out of the port 32 by the diaphragm 25 as pushed into the pump chamber 26. The accelerator pump 23 is thus readied for normal operation. For discharging such fuel vapor from the accelerator pump 23 and the fuel supply and feed passages 28, 31, the accelerator pump 23 should preferably be actuated for one stroke thereof.

The accelerator pump 23 will operate for engine acceleration as follows. When the driver steps on the accelerator pedal, the throttle wire 22 is pulled up in the direction of the arrow 57 to turn the throttle lever 21 clockwise in the direction of the arrow 58 about the shaft 18. The connector link 35 is pushed to the left to turn the plate cam 33 clockwise in the direction of the arrow 62 about the pin 34. As the plate cam 33 is turned, its cam edge **33*a* displaces the roller follower 38 leftward causing the pump lever 36 to turn in the direction of the arrow 60. The cam edge 33*a* is profiled such that as the primary throttle valve 17 is opened, the pump lever 36 is proportionally swung by the plate cam 33. Since the accelerator pump 23 has already been normalized for its operation, it now supplies the primary intake passage 18 with extra fuel in an amount proportional to the opening of the primary throttle valve 17** to thereby meet a sudden demand for additional fuel upon acceleration.

The accelerator pump system of the present invention can be incorporated in an internal combustion engine having an intake manifold composed of primary and secondary manifold passages with a partition therebetween.

Although a certain preferred embodiment has been shown and described in detail, it should be understood that many changes and modifications may be made therein without departing from the scope of the appended claims.

What is claimed is:

1. An accelerator pump system for an internal combustion engine, comprising:

(a) a two-barrel carburetor which comprises a primary intake passage for supplying an air-fuel mixture to the engine when the engine operates under a full range of loads, and a secondary intake passage for supplying an air-fuel mixture to the engine when the engine operates under relatively high loads, the primary intake passage having a primary throttle valve disposed therein;

(b) an accelerator pump actuable in response to opening of said primary throttle valve for supplying additional fuel into said primary intake passage, said accelerator pump having a housing mounted on said two-barrel carburetor;

(c) a throttle lever fixed to said primary throttle valve, a plate cam pivotally mounted on said two-barrel carburetor, a connector link operatively connected between said throttle lever and said plate cam, and a pump lever pivotally mounted on said housing for actuating said accelerator pump in response to movement of said plate cam; and (d) means for actuating said accelerator pump in response to cranking of the engine, comprising a vacuum-operated actuator having a vacuum chamber, a diaphragm defining said vacuum chamber, an actuator link attached to said diaphragm, an actuator lever pivotally mounted on said housing and operatively connected to said actuator link, said actuator lever having a hook engageable with said pump lever, and a vacuum passage system for delivering a vacuum developed in response to cranking of the engine into said vacuum chamber, whereby said accelerator pump can be actuated by said actuator lever engaging said pump lever when said vacuum-operated actuator is actuated upon cranking of the engine.

2. An accelerator pump system according to claim 1, wherein said cam plate has a cam edge, said pump lever having a roller follower held in rolling engagement with said cam edge, said cam edge being profiled such that said pump lever can swing proportionally in response to the opening of said primary throttle valve.

3. An accelerator pump system according to claim 2, wherein said accelerator pump comprises a plunger movably supported in said housing, a diaphragm mounted in said housing and defining a pump chamber therein, a fuel supply passage for supplying fuel to said pump chamber, and a fuel feed passage for feeding fuel from said pump chamber into said primary intake passage, said pump lever having a presser remote from said roller follower and held in engagement with said plunger.

4. An accelerator pump system according to claim 1, including an intake manifold connected to said two-barrel carburetor, said vacuum passage system comprising a vacuum pickup port opening into said intake manifold, a first vacuum passage extending from said vacuum pickup port, a second vacuum passage extending from said vacuum chamber of said vacuum-operated actuator, and a directional control valve for connecting said first and second vacuum passages in response to the cranking of the engine.

5. An accelerator pump system according to claim 4, including an ignition switch for energizing said directional control valve to connect said first and second vacuum passages.

* * * * *